US005775137A

United States Patent [19]

Yanagisawa

[11] Patent Number: 5,775,137

[45] Date of Patent: Jul. 7, 1998

[54] AGITATOR

[75] Inventor: Ken Yanagisawa, Matsumoto, Japan

[73] Assignee: Yugen Kaisha Sozoan, Nagano, Japan

[21] Appl. No.: 630,988

[22] Filed: Apr. 12, 1996

[30] Foreign Application Priority Data

Apr. 14, 1995 [JP] Japan ..... 7-089750

[51] Int. Cl.[6] ..... D06F 17/10; D06F 17/08; B01F 7/18

[52] U.S. Cl. ..... 68/133; 68/132; 68/134; 366/241

[58] Field of Search ..... 68/131, 132, 133, 68/134, 74, 79, 80, 84, 89, 92, 136, 137; 366/241

[56] References Cited

U.S. PATENT DOCUMENTS

| | | | |
|---|---|---|---|
| 1,447,760 | 3/1923 | Churchill et al. | 68/136 |
| 3,095,721 | 7/1963 | Bochan | 68/133 |

FOREIGN PATENT DOCUMENTS

| | | | |
|---|---|---|---|
| 912696 | 5/1946 | France | 68/131 |
| 809073 | 7/1951 | Germany | 68/131 |
| 41-10178 | 5/1966 | Japan . | |
| 51-25544 | 7/1976 | Japan . | |
| 55-37101Y2 | 9/1980 | Japan . | |
| 57-203491A | 12/1982 | Japan . | |
| 59-176474U | 11/1984 | Japan . | |
| 61-29464Y2 | 8/1986 | Japan . | |
| 62-13482U | 1/1987 | Japan . | |
| 2-5863 Y2 | 2/1990 | Japan . | |
| 2-210266A | 8/1990 | Japan . | |

*Primary Examiner*—Philip R.. Coe

*Attorney, Agent, or Firm*—Birch, Stewart, Kolasch & Birch, LLP

[57] ABSTRACT

An agitator is capable of efficiently agitating clothing without damaging fibers of the clothing. The agitator includes an agitating section having agitating pieces, which are capable of agitating clothes, or any other medium, and a driving mechanism for moving the agitating section. The driving mechanism moves the agitating section in a plane such that each agitating piece moves in a substantially identically shaped path.

15 Claims, 8 Drawing Sheets

AGITATOR

BACKGROUND OF THE INVENTION

The present invention relates to an agitator and, more precisely relates to an agitator comprising: an agitating section having an agitating piece capable of agitating a medium or, member to be agitated; and a driving mechanism for driving the agitating section.

An electric washer has been known as one of examples of agitators, which agitate fluids, powders, etc. (members to be agitated).

The conventional electric washer swirls water with high speed by revolving rotary fins (the agitating pieces), which are provided in an inner bottom part of a washtub. By the high speed swirling water, washing can be executed in a short time.

A rotary mixer comprising a rotary shaft and the agitating section, which has the agitating pieces and which is attached to the rotary shaft, has been known as one of agitators, wherein the rotary shaft is rotated to mix or agitate foods, etc. (the members to be agitated).

In the conventional electric washer, since the swirling water twists clothes to be washed, fibers of the clothes are damaged. And energy of the rotary fins is mainly consumed to generate centrifugal force, so that agitating efficiency cannot be raised. To improve these disadvantages, some electric washers revolve the rotary fins in the reverse direction.

However, even if the rotary fins are revolved in the reverse direction, twisting clothes cannot be fully prevented, further by frequently starting and stopping the rotary fins to change the rotational directions, energy consumption must be greater and working efficiency of the electric washer must be lower.

In the conventional rotary mixer, the agitating section is revolved in one direction, so that fibers of members to be agitated are apt to be damaged and agitating efficiency must be low as well as the conventional electric washer.

SUMMARY OF THE INVENTION

An object of the present invention is to provide an agitator, which is capable of efficiently agitating members to be agitated without damaging fibers of the members.

To achieve the object, the agitator of the present invention comprises:

an agitating section having an agitating piece, which is capable of agitating a member to be agitated; and a driving mechanism for moving the agitating section, wherein the driving mechanism moves the agitating section in a plane without revolving on its axis.

The agitator may further comprise a reservoir section in which the member to be agitated is stored, and the agitating section may be provided in an inner bottom part of the reservoir section.

The agitator may further comprise a reservoir section in which the member to be agitated is stored, and the agitating section may be provided in an upper part of the reservoir section, and the agitating piece may be extended downward therefrom.

The agitator may further comprise a reservoir section in which the member to be agitated is stored, and the agitator may have two agitating sections: one of the agitating sections is provided in an inner bottom part of the reservoir section; and the other is provided in an upper part of the reservoir section, the agitating piece is extended downward therefrom.

The agitator may further comprise a grip section in which the driving mechanism is accommodated, and the agitating section may be detachably attached to the grip section.

In the agitator, the driving mechanism may include:

a plurality of levers, each of which comprises a lever proper, an input shaft and an output shaft which are provided parallel, with a prescribed space, in the lever proper;

a base section for pivotably holding the input shafts of the levers; and means for synchronously rotating the input shafts of the levers, and wherein the output shafts of the levers are pivotably connected with the agitating section.

In the agitator, the driving mechanism may include:

a first rotary shaft and a second rotary shaft being capable of respectively rotating on their axes, the first rotary shaft and the second rotary shaft being arranged in a first direction with a space;

a third rotary shaft and a fourth rotary shaft being capable of respectively rotating on their axes, the third rotary shaft and the fourth rotary shaft being arranged in a second direction perpendicular to the first direction with a space;

a first lever whose one part is fixed to the first rotary shaft, whereby the first lever is rotated together with the first rotary shaft;

a second lever whose one part is fixed to the second rotary shaft, whereby the second lever is rotated together with the second rotary shaft;

a third lever whose one part is fixed to the third rotary shaft, whereby the third lever is rotated together with the third rotary shaft;

a fourth lever whose one part is fixed to the fourth rotary shaft, whereby the fourth lever is rotated together with the fourth rotary shaft;

a first moving guide whose one end is pivotably connected with the other part of the first lever, and whose the other end is pivotably connected with the other part of the second lever;

a second moving guide whose one end is pivotably connected with the other part of the third lever, and whose the other end is pivotably connected with the other part of the fourth lever;

a moving body being capable of moving on the first moving guide and a second moving guide;

first means for rotating the first rotary shaft and/or the second rotary shaft; and second means for rotating the third rotary shaft and/or the fourth rotary shaft.

In the agitator, the driving mechanism may include:

a first guide being arranged in a first direction;

a second guide being arranged in a second direction perpendicular to the first direction;

a moving body to which the agitating section is fixed, the moving body being capable of moving in the first direction along the first guide and in the second direction along the second guide in a plane without revolving on its axis; and means for moving the moving body.

In the agitator, the driving mechanism may include:

a pair of first guides being arranged parallel in a first direction;

a pair of second guides being arranged parallel in a second direction perpendicular to the first direction;

a first moving guide being arranged parallel to the first guides, each end of the first moving guide being movably connected with each of the second guides whereby the first moving guide is capable of moving in the second direction along the second guides;

a second moving guide being arranged parallel to the second guides, each end of the second moving guide being movably connected with each of the first guides whereby the second moving guide is capable of moving in the first direction along the first guides;

a moving body to which the agitating section is fixed, the moving body being capable of moving in the first direction and the second direction, in a rectangular plane enclosed by the first guides and the second guides, on the first moving guide and the second moving guide;

first means for moving the first moving guide; and second means for moving the second moving guide.

In the agitator of the present invention, the member to be agitated can be agitated without revolving the agitating section on its own axis. With this agitation, the member can be agitated by collision of the stream, which is caused by the agitating piece of the agitating section. Even if the agitating section is moved at high speed, the member does not wind around the agitating piece. Thus, fibers of the member are not damaged, and the agitating efficiency can be raised.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

(FIRST EMBODIMENT)

Figure 1:
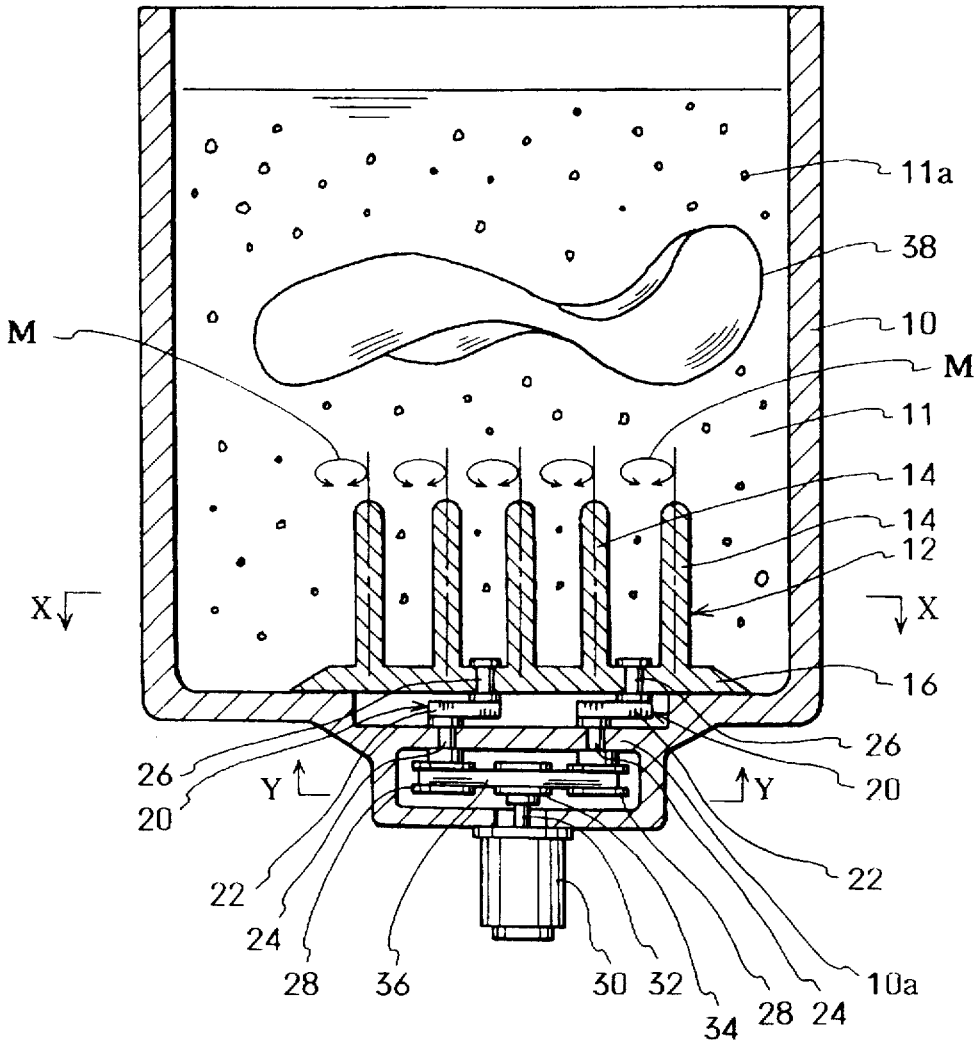
FIG. 1 is a front sectional view of an electric washer, which is a First Embodiment of the present invention.
Figure 2:
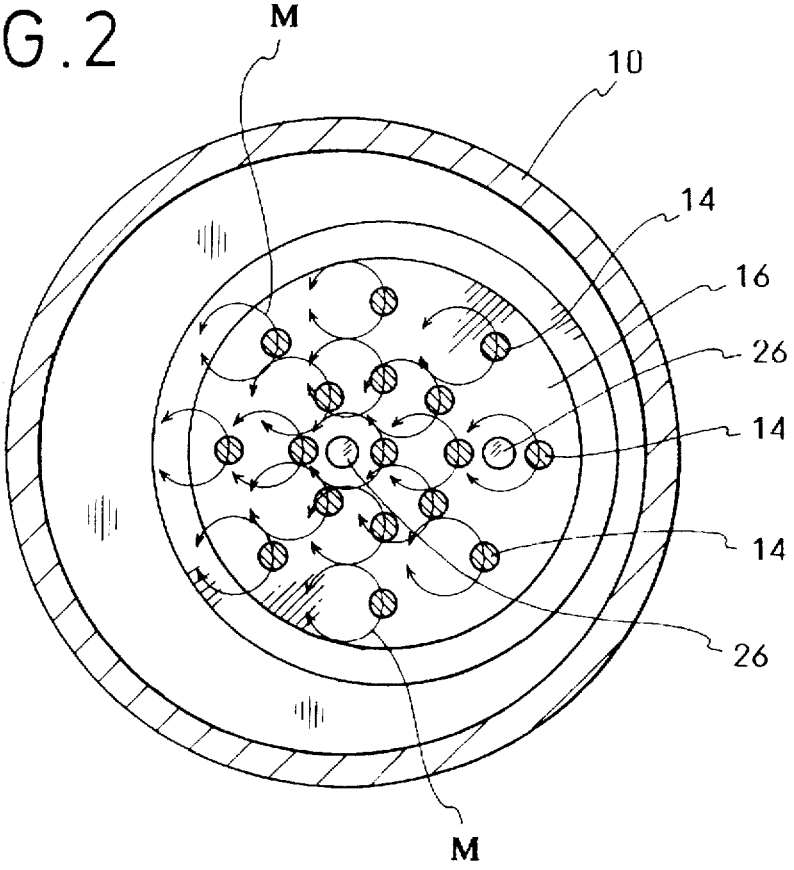
FIG. 2 is a sectional view taken along a line X—X in FIG. 1.
Figure 3:
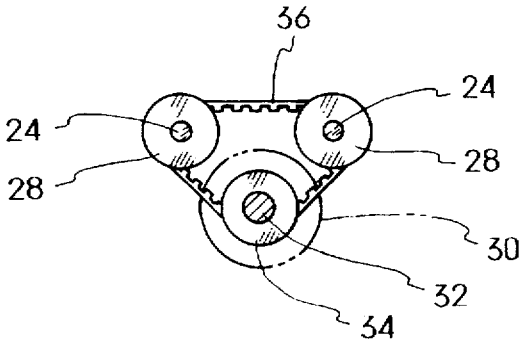
FIG. 3 is a sectional view taken along a line Y—Y in FIG. 1.

A First Embodiment will be explained with reference to FIGS. 1–5. Firstly, FIG. 1 is a front sectional view of an electric washer of the First Embodiment; FIG. 2 is a sectional view taken along a line X—X in FIG.1; and FIG. 3 is a sectional view taken along a line Y—Y in FIG. 1.

Water 11 is accommodated in a washtub 10, which is an example of reservoir. There is provided an agitating section 12 in an inner bottom part of the washtub 10.

Figure 4:
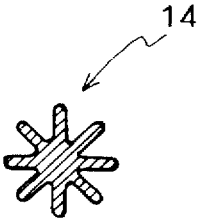
FIG. 4 is a sectional view of an agitating piece.

The agitating section 12 is located in water 11, which is an example of members to be agitated. Detergents 11*a* are supplied in the water 11. A plurality of agitating pieces 14, which agitate the water 11 and the detergents 11*a* are attached, to the agitating section 12. The agitating pieces 14 are projected upward from a circular plate section 16. As shown in FIGS. 1 and 2, the agitating pieces 14 are provided with prescribed spaces. Note that, a shape of the agitating pieces 14 can be optionally designed. A sectional shape of the agitating pieces 14 may be designed, for example, as shown in FIG. 4. The length, diameter, number, etc. of the agitating pieces 14 can be designed according to washing conditions.

A plurality of lever assemblies 20 (two lever assemblies in the First Embodiment) are provided. Each lever assembly 20 has a first lever or lever proper 22. An input shaft and an input shaft 24 and an output shaft 26, which are provided parallel to one another, are connected to the lever proper 22 with a prescribed space therebetween. In the First Embodiment, the input shaft 24 is projected downward from the lever proper 22 and; the output shaft 26 is projected upward from the lever proper 22. Thus, the lever assembly 20 is formed into a crank shape. The input shafts 24 of the lever assemblies 20 are rotatably pierced through a bottom wall of the washtub 10, which is a base section 10*a*. The two lever assemblies 20 are formed to have the same shape, including the distance between the input shaft 24 and the output shaft 26 is.

There are respectively fixed pulleys 28 to each input shaft 24. There is fixed a pulley 34 to a rotary shaft 32 of a motor 30. As shown in FIG. 3, the pulleys 28 and 34 are arranged in a triangular form, and a timing belt 36 is engaged with the pulleys. They constitute a rotating means, which synchronously rotates the two input shafts 24.

The output shafts 26 are rotatably pierced through the plate section 16 so as to the two lever assemblies 20 with the agitating section 12. With this structure, the agitating section 12 is rotated in a plane without revolving on its own axis. When the motor 30 rotates the lever assemblies 20, so that the water 11 and the detergents 11*a* can be agitated. The lever assemblies 20, the base section 10*a*, the motor 30, the pulleys 28 and 30, and the timing belt 36 constitute a driving mechanism.

Note that, if there are provide three or more lever assemblies 20 in the driving mechanism, the agitating section 12 can be moved more stably.

Next, the action of the agitating section 12 will be described in detail.

Figure 5:
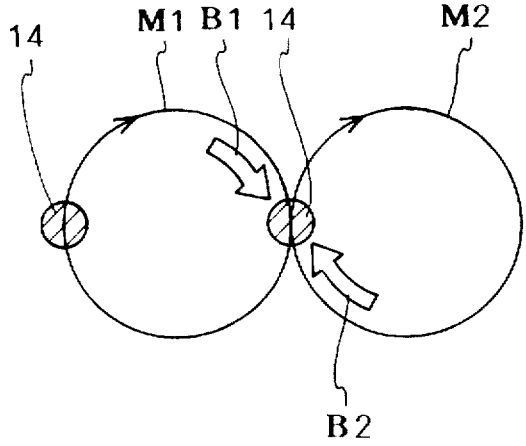
FIG. 5 is an explanation view showing an agitating theory.

Moving without revolving on the axis, all points in the agitating section 12 can be moved the same (see arrows M in FIGS. 1 and 2, which show the movement of the agitating pieces 14). By the same movement, the agitating piece 14 is capable of agitating the water 11 and the detergents 11*a* with the same conditions. As shown in FIG. 5, water streams B1 and B2, which are caused by the movement M1 and M2 of the agitating pieces 14, are collided to agitate the water 11 and the detergents 11*a*. Namely, great water swirling, which is caused in the conventional electric washer, is not caused in the washer of the present embodiment. Thus, agitating efficiency can be raised, and washing can be executed effectively.

In the First Embodiment, since the agitating pieces 14 are moved in the plane without the plane revolving on its own axis, even if the agitating pieces 14 are moved round, in one direction, at high speed, clothes 38 in the washtub are not wound around the agitating pieces 14 and tightly twisted. Therefore, the clothes 38 can be washed without damaging their fibers.

(SECOND EMBODIMENT)

Figure 6:
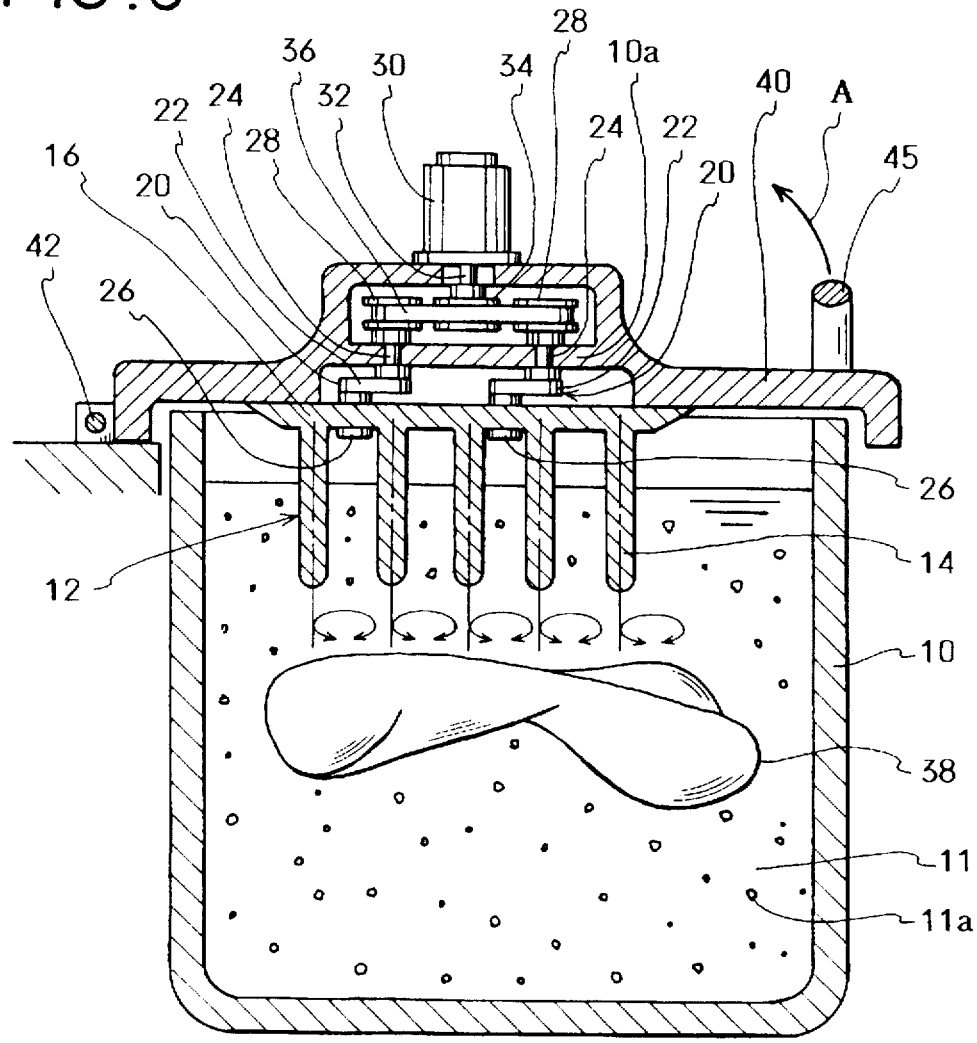
FIG. 6 is a front sectional view of an electric washer, which is a Second Embodiment.

A Second Embodiment will be explained with reference to FIG. 6. Note that, elements shown in the First Embodiment are assigned the same reference numerals of the First Embodiment and explanation will be omitted.

The agitating section 12 is provided on an inner side of a lid 40 of the washtub 10, and the agitating pieces are projected downward. With this structure, the agitating pieces 14 can be inserted into the washtub 10 from an upper side. The lid 40 acts as the base section 10*a*, and the basic structure of the driving mechanism is the same as that of the First Embodiment.

The lid 40 is pivotably attached to the washtub 10 with an axis 42, so that the lid is capable of opening and closing an upper opening section of the washtub. If a user grips a handle 45 and turns the lid 40 in the direction of an arrow A, the upper opening section of the washtub 10 is opened, so that the clothes 38 to be washed can be put therein.

The Second Embodiment has effects as well as the First Embodiment. Further, by providing the agitating section 12 and the driving mechanism to the lid 40, the structure of the washtub 10 can be simpler. And no sealing means are required in the washtub 10.

(THIRD EMBODIMENT)

Figure 7:
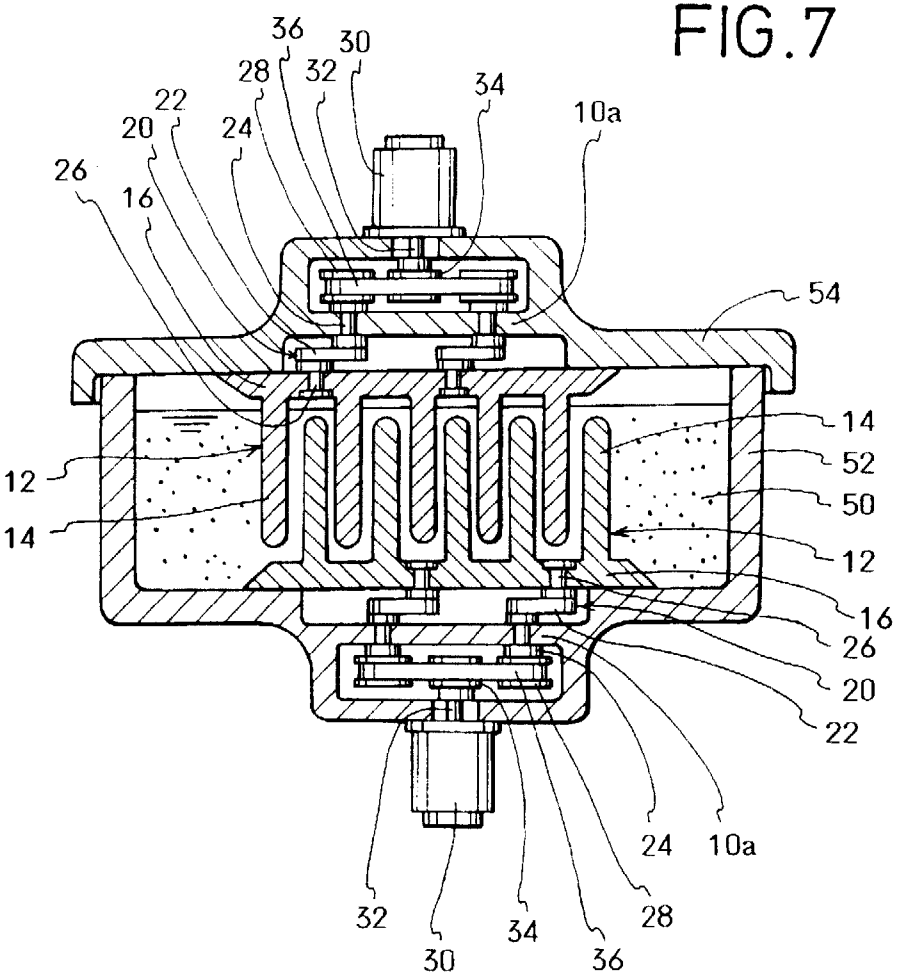
FIG. 7 is a front sectional view of a mixer, which is a Third Embodiment.

A Third Embodiment will be explained with reference to FIG. 7. Note that, elements shown in the foregoing embodiments are assigned the same reference numerals and explanation will be omitted.

The agitator of the Third Embodiment is a mixer.

Two agitating sections 12 are respectively provided in the inner bottom part of a reservoir 52, in which members 50 to be agitated are accommodated, and to an upper lid 54, which opens and closes an upper opening section of the reservoir 52. The structures of the agitating sections 12 and the driving mechanisms for rotating the agitating sections 12 are as well as the foregoing embodiments. Note that, to prevent interference among the agitating pieces 14 on the upper side and on the lower side, tracks or orbits of each agitating pieces 14 are properly designed.

Since the members 50 are agitated by the upper and the lower agitating sections 12, they can be more effectively agitated.

(FOURTH EMBODIMENT)

Figure 8:
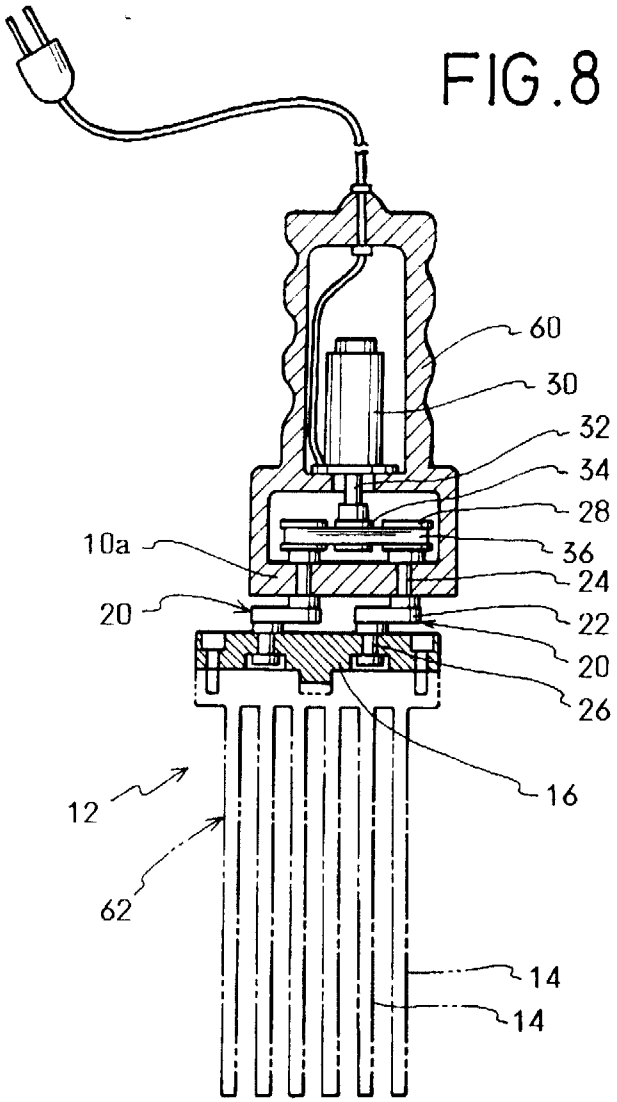
FIG. 8 is a front sectional view of a hand mixer, which is a Fourth Embodiment.

Next, a Fourth Embodiment will be explained with reference to FIG. 8. Note that, elements shown in the foregoing embodiments are assigned the same reference numerals and explanation will be omitted.

The agitator of the Fourth Embodiment is a hand mixer.

A grip section 60 acts as the base section 10*a*, which pivotably hold the input shafts 24 of the lever assemblies 20.

The agitating section 12 comprises: the circular plate section 16, which is connected with the lever assemblies 20; and a head section 62, which includes a plurality of the agitating pieces 14 and which is detachably attached to the plate section 16.

Many kinds of the head sections 62 can be employed. Thus, the head section can be selected according to agitating conditions.

The Fourth Embodiment has effects as well as the First and the Second Embodiments. Further, the hand mixer can be used easily. By changing the head section 62, the hand mixer can be used for many kinds of agitation and mixing.

(FIFTH EMBODIMENT)

Next, a Fifth Embodiment will be explained with reference to FIGS. 9 and 10.

The agitator of the Fourth Embodiment is an electric washer, so elements shown in the First, the Second and the Third Embodiments are assigned the same reference numerals and explanation will be omitted.

Figure 9:
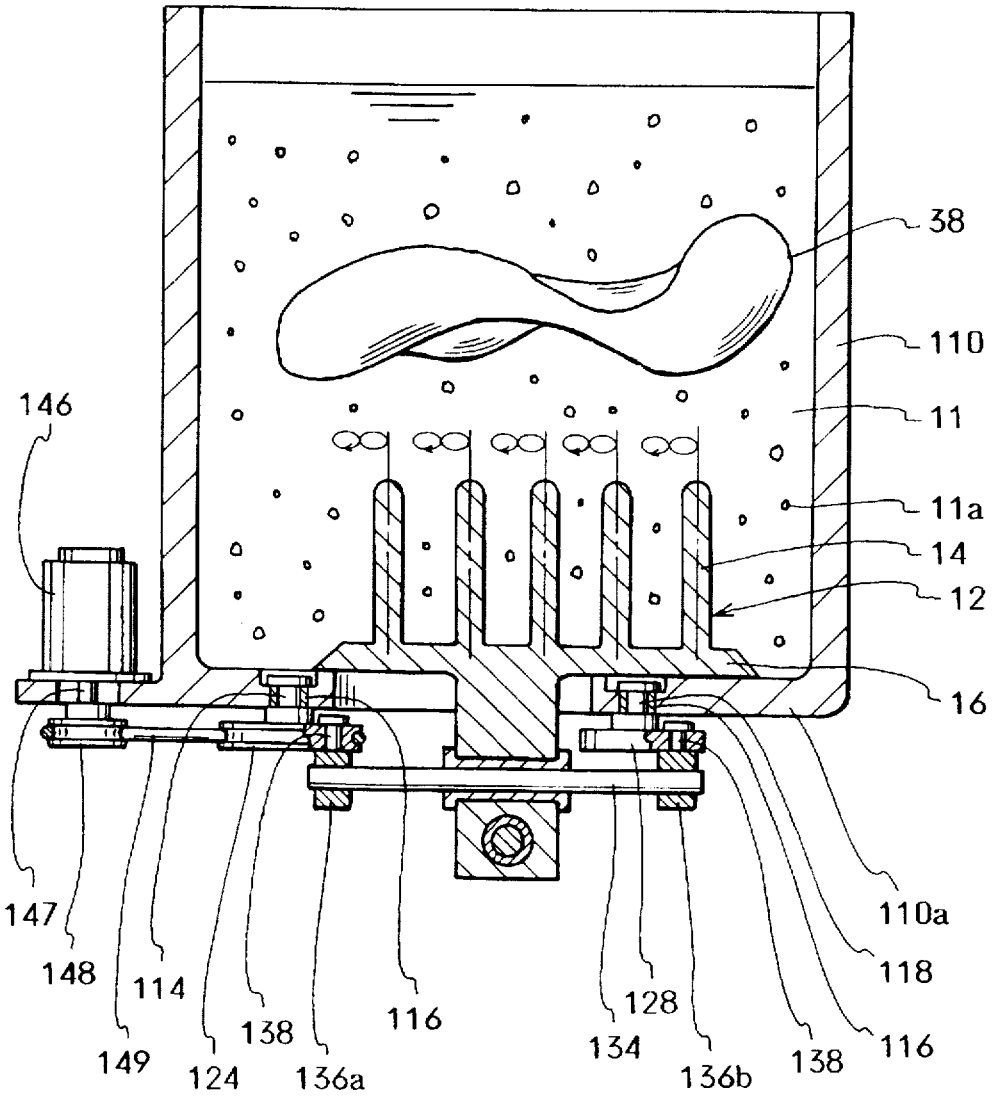
FIG. 9 is a front sectional view of an electric washer, which is a Fifth Embodiment.

FIG. 9 is a front sectional view of the electric washer of the Fifth Embodiment; FIG. 10 is a bottom view thereof.

A bottom shape of a washtub 110 is different from that of the First Embodiment. A bottom part of the washtub 110 acts as a base section 110*a*.

The structure of the agitating section 12 of the Fifth Embodiment is the same as that of the First Embodiment. But the driving mechanism for moving the agitating section 12 is different. Now, the driving mechanism of the present embodiment will be explained.

A first rotary shaft 114 is pivotably held in the base section 110*a* with a bearing 116, which is fixed in the base section 110*a*, and is capable of rotating on the vertical axial line.

A second rotary shaft 118 is pivotably held in the base section 110*a* with a bearing 116, which is fixed in the base section 110*a*, and is capable of rotating on the vertical axial line. The first rotary shaft 114 and the second rotary shaft 118 are arranged parallel and spaced in a first direction: an X-direction.

A third rotary shaft 120 is pivotably held in the base section 110*a* with a bearing, which is fixed in the base section 110*a*, and is capable of rotating on the vertical axial line.

A fourth rotary shaft 122 is pivotably held in the base section 110*a* with a bearing, which is fixed in the base section 110*a*, and is capable of rotating on the vertical axial line. The third rotary shaft 120 and the fourth rotary shaft 122 are arranged parallel and spaced in a second direction: a Y-direction.

Figure 10:
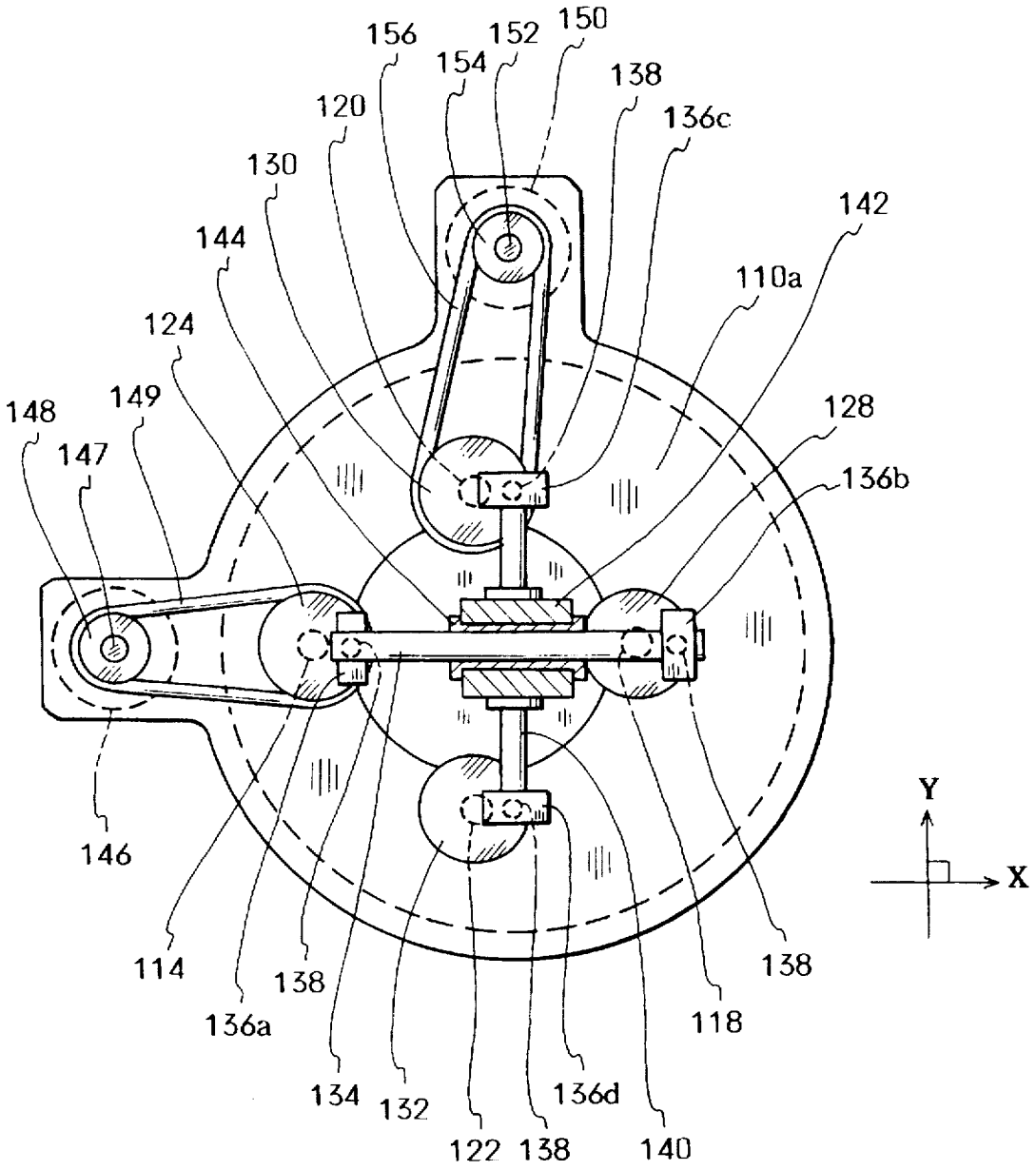
FIG. 10 is a bottom view of the electric washer shown in FIG. 9.

Namely, the first rotary shaft 114, the second rotary shaft 118, the third rotary shaft 120 and the fourth rotary shaft 122 are mutually arranged, in the base section 110*a*, with angle of 90° (see FIG. 10).

A first lever 124 is formed into a circular disc, and its center part (a one part) is fixed to the first rotary shaft 114, so that the first lever is capable of rotating together with the first rotary shaft 114.

A second lever 128 is formed into a circular disc, and its center part (a one part) is fixed to the second rotary shaft 118, so that the second lever is capable of rotating together with the second rotary shaft 118.

A third lever 130 is formed into a circular disc, and its center part (a one part) is fixed to the third rotary shaft 120, so that the third lever is capable of rotating together with the third rotary shaft 120.

A fourth lever 132 is formed into a circular disc, and its center part (a one part) is fixed to the fourth rotary shaft 122, so that the fourth lever is capable of rotating together with the fourth rotary shaft 122.

An X-rod 134 is the first moving guide. Each end of the X-rod 134 is respectively fixed to connecting members 136*a* and 136*b*.

A shaft section 138 of the connecting member 136*a* is pivotably connected with the other part of the first lever 124. On the other hand, a shaft section 138 of the connecting member 136*b* is pivotably connected with the other part of the second lever 128. Thus, a parallel link is constituted by the first lever 124, the second lever 128 and the X-rod 134, wherein the X-rod 134 can be moved, in the Y-direction, parallel to the X-axis by the parallel link. Note that, the first moving guide is not limited to the rod of the embodiment, a linear guide, for example, may be employed as the moving guide.

A Y-rod 140 is the second moving guide. Each end of the Y-rod 140 is respectively fixed to connecting members 136*c* and 136*d*.

A shaft section 138 of the connecting member 136*c* is pivotably connected with the other part of the third lever 130. On the other hand, a shaft section 138 of the connecting member 136*d* is pivotably connected with the other part of the fourth lever 132. Thus, a parallel link is constituted by the third lever 130, the fourth lever 132 and the Y-rod 140, wherein the Y-rod 140 can be moved, in the X-direction, parallel to the Y-axis by the parallel link. Note that, the second moving guide is not limited to the rod of the embodiment, a linear guide, for example, may be employed as the moving guide.

The distance between the first rotary shaft 114 and the connecting member 136*a* is equal to the distance between the second rotary shaft 118 and the connecting member 136*b*. The distance between the third rotary shaft 120 and the connecting member 136*c* is equal to the distance between the fourth rotary shaft 122 and the connecting member 136*d*.

The X-rod 134 and the Y-rod 140 are pierced through a moving body 142 with slide bearings 144, and they are crossed at right angle. With this structure, the moving body 142 is capable of moving on the X-rod 134 and the Y-rod 140. Namely, the moving body 142 is capable of moving in the X- and the Y-directions with the movement of the the X-rod 134 and the Y-rod 140. The agitating section 12 is provided in an upper part of the moving body 142.

A first motor 146 is a first rotating means. The first motor 146 is fixed to the base section 110*a*, and its motor shaft 147 is extended downward. A pulley 148 is fixed to the motor shaft 147. There is formed a groove on an outer circumferential face of the circular first lever 124, so the first lever acts as a pulley 124, too. A belt 149 is engaged with the pulleys 148 and 124. When the first motor 146 rotates the first rotary shaft 114, the second rotary shaft 118, which constitutes the parallel link with the first rotary shaft 114, is rotated, in the same direction, at the same speed. By rotating the shafts, the X-rod 134 can be moved in the Y-direction. Many kinds of rotating means, e.g., a servo motor, may be employed as the first rotating means. In the present embodiment, the first rotating means directly rotates the first rotary shaft 114 only, but it may directly rotate the second rotary shaft 118 only, further a pair or first rotating means may synchronously rotate the first rotary shaft 114 and the second rotary shaft 118.

A second motor 150 is a second rotating means. The second motor 150 is fixed to the base section 110*a*, and its motor shaft 152 is extended downward. A pulley 154 is fixed to the motor shaft 152. There is formed a groove on an outer circumferential face of the circular third lever 130, so the third lever acts as a pulley 130, too. A belt 156 is engaged with the pulleys 154 and 130. When the second motor 150 rotates the third rotary shaft 120, the fourth rotary shaft 122, which constitutes the parallel link with the third rotary shaft 120,is rotated, in the same direction, at the same speed. By rotating the shafts, the Y-rod 140 can be moved in the X-direction. Many kinds of rotating means, e.g., a servo motor, may be employed as the second rotating means. In the present embodiment, the second rotating means directly rotates the third rotary shaft 120 only, but it may directly rotate the fourth rotary shaft 122 only, further a pair or second rotating means may synchronously rotate the third rotary shaft 120 and the fourth rotary shaft 122.

In the driving mechanism of the Fifth Embodiment, the first motor 146 and the second motor 150 are controlled by a control unit (not shown), which includes a computer system. By controlling the rotational direction, the rotational speed and the rotational angle of the motor shaft 147 of the first motor 146, the rotational direction, the rotational speed and the rotational angle of the first rotary shaft 114 and the second rotary shaft 118 can be controlled. Thus, the moving direction, the moving speed and the moving length of the X-rod 134 can be controlled. On the other hand, by controlling the rotational direction, the rotational speed and the rotational angle of the motor shaft 152 of the second motor 150, the rotational direction, the rotational speed and the rotational angle of the third rotary shaft 120 and the fourth rotary shaft 122 can be controlled. Thus, the moving direction, the moving speed and the moving length of the Y-rod 140 can be controlled.

By controlling the moving direction, the moving speed and the moving length of the X-rod 134 and the Y-rod 140, the moving direction, the moving speed and the moving length of the moving body 142 with the agitating section 12 can be controlled. Above described computer control can be executed on the basis of, for example, a data table of the moving direction, the moving speed and the moving length of the moving body 142 with respect to the rotational direction, the rotational speed and the rotational angle of the motor shaft 147 and 152 of the first motor 146 and the second motor 150, which have been previously calculated or measured.

The Fifth Embodiment has effects as well as the First Embodiment. And, since the moving body 142 and the agitating section 12 are driven by two motors and supported at four points, the agitator is capable of agitating with greater agitating force. Further, since the moving body 142 can be moved optionally by controlling the first motor 146 and the second motor 150, the agitator can be used under many conditions, so that it can be employed for a wide use.

(SIXTH EMBODIMENT)

A Sixth Embodiment will be explained with reference to FIGS. 11–13.

The agitator of the Sixth Embodiment is an electric washer, so elements shown in the foregoing embodiments are assigned the same reference numerals and explanation will be omitted.

Figure 11:
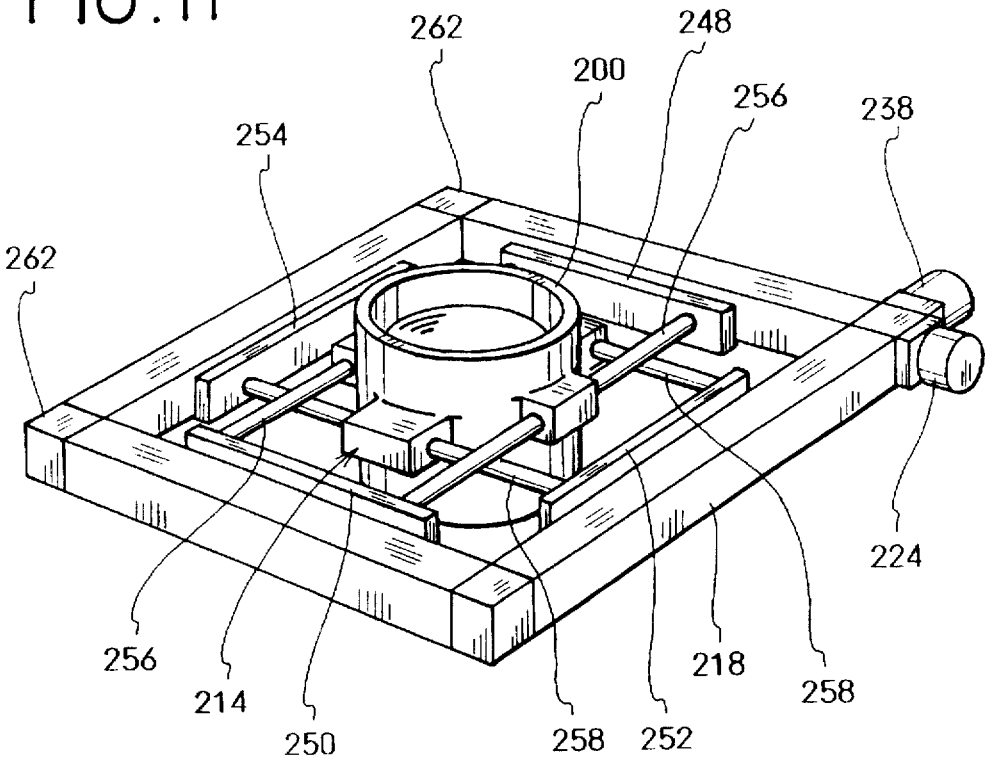
FIG. 11 is a perspective view of an electric washer, which is a Sixth Embodiment.

FIG. 11 is a perspective view of the electric washer of the Sixth Embodiment; FIG. 12 is a front sectional view of a washtub; FIG. 13 is a plan view of the driving mechanism.

Figure 12:
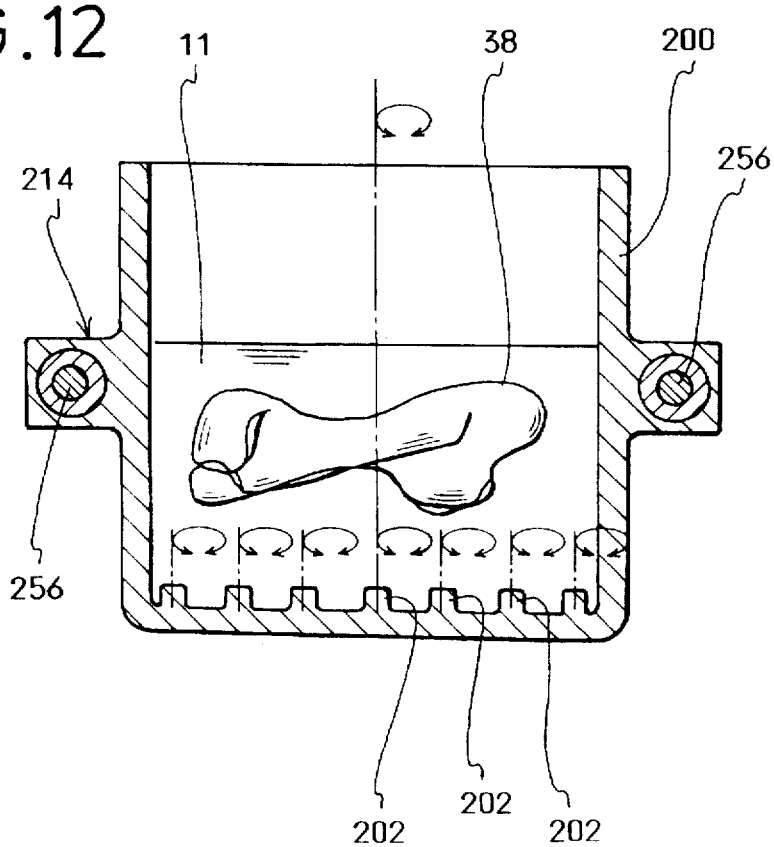
FIG. 12 is a front sectional view of a washtub of the electric washer of the Sixth Embodiment.
Figure 13:
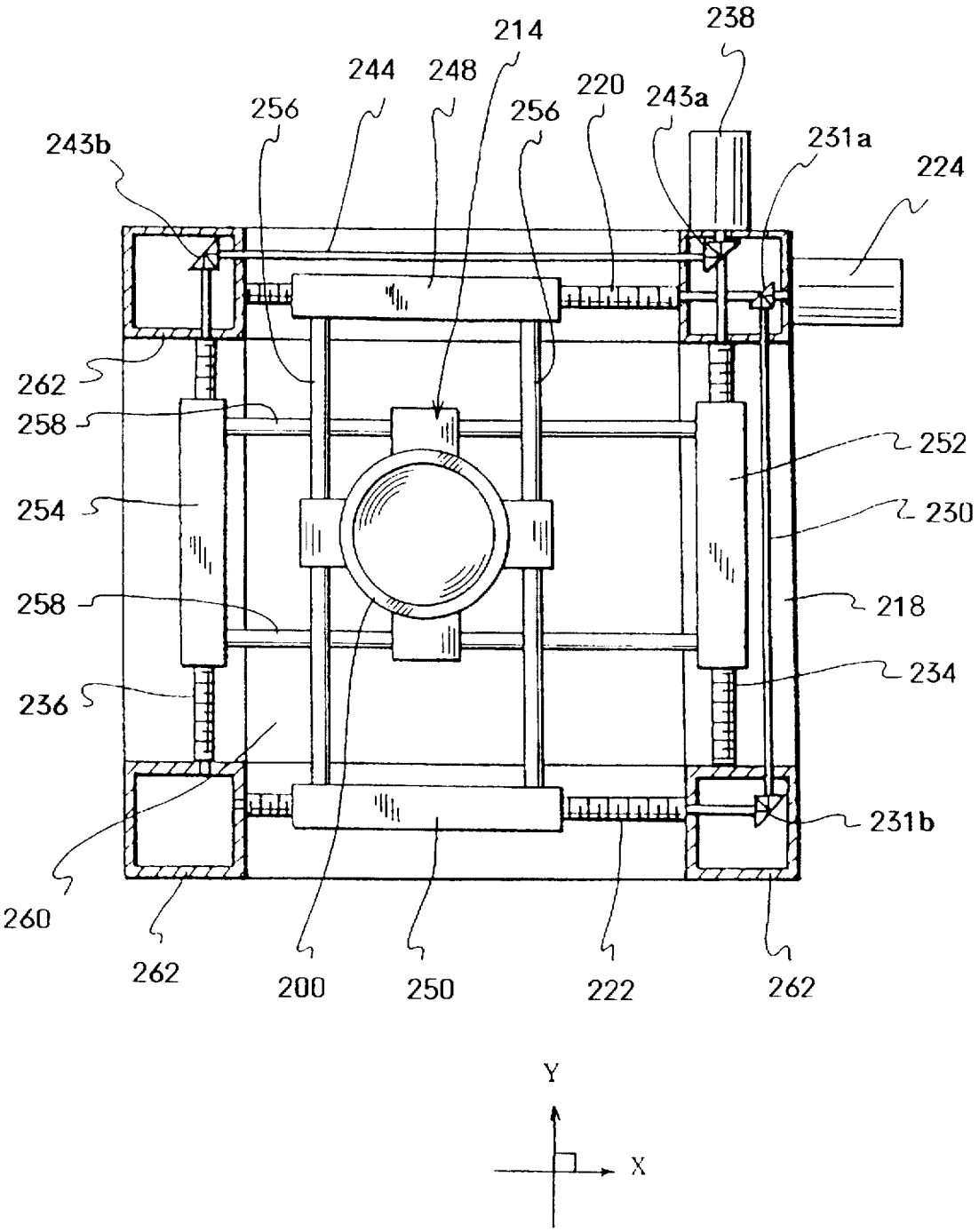
FIG. 13 is a plan view of a driving mechanism of the Sixth Embodiment.

There are projected a plurality of agitating pieces 202 from an inner bottom face of the washtub 200 as shown in FIG. 12.

The washtub 200 is integrally provided to a moving body 214, which constitutes the driving mechanism, and is capable of moving, with optionally tracks, in a plane without revolving on its own axis.

The driving mechanism of the Sixth Embodiment will be explained with reference to FIG. 13.

A frame 218 is formed in a hollow rectangular frame.

X-ball screws 220 and 222 are arranged parallel on the frame 218. The X-ball screw 220 is directly rotated by an X-motor 224. Torque of the X-motor 224 is transmitted to the X-ball screw 222 via a first transmitting mechanism, which includes bevel gears 231*a* and 231*b* and a transmitting shaft 230. Front ends (left ends) of the X-ball screws 220 and 222 are pivotably supported by corner boxes 262. The X-ball screws 220 and 222 act as a first guide. And the X-ball screws 220 and 222 move the moving body 214 in the X-direction as a second moving means.

Y-ball screws 234 and 236 are arranged parallel on the frame 218. The Y-ball screws 234 and 236 are arranged perpendicular to the X-ball screws 220 and 222. The Y-ball screw 234 is directly rotated by an Y-motor 238. Torque of the Y-motor 238 is transmitted to the Y-ball screw 236 via a second transmitting mechanism, which includes bevel gears 243*a* and 243*b* and a transmitting shaft 244. Front ends (lower ends) of the Y-ball screws 234 and 236 are pivotably supported by corner boxes 262. The Y-ball screws 234 and 236 act as a second guide. And the Y-ball screws 234 and 236 move the moving body 214 in the Y-direction as a first moving means.

X-travellers 248 and 250 are respectively screwed with the X-ball screws 220 and 222. Since rotation of the X-travellers 248 and 250 are prevented by Y-rods 256, they can move together in the X-direction when the X-ball screws 220 and 222 are rotated in the same direction.

Y-travellers 252 and 254 are respectively screwed with the Y-ball screws 234 and 236. Since rotation of the Y-travellers 252 and 254 are prevented by X-rods 258, they can move together in the Y-direction when the Y-ball screws 234 and 236 are rotated in the same direction.

Two Y-rods 256 are arranged parallel. The Y-rods 256 are pierced through the moving body 214, and their ends are respectively fixed to the X-travellers 248 and 250. With this structure, the moving body 214 is moved in the X-direction with the movement of the X-travellers 248 and 250, which are connected by the Y-rods 256, in the X-direction.

Two X-rods 258 are arranged parallel. The X-rods 258 are pierced through the moving body 214, and their ends are respectively fixed to the Y-travellers 252 and 254. With this structure, the moving body 214 is moved in the Y-direction with the movement of the Y-travellers 252 and 254, which are connected by the X-rods 258, in the Y-direction.

Note that, metal shafts having enough toughness and elasticity may be employed as the Y-rods 256 and the X-rods 258.

By combining the movement of the moving body 214 in the X- and the Y-directions, the moving body 214 is capable of optionally moving in a rectangular plane 260 with optional tracks or orbits. By crossing the Y-rods 256 and the X-rods 258, at the right angle, in the moving body 214, the moving body 214 is unable to revolve on its own axis, and its heading with respect to the X- and Y-axes can be fixed.

The corner boxes 262 are provided at each corner of the frame 218, and they cover the bevel gears 231*a*, 231*b*, 243*a* and 243*b*, etc.

In the Sixth Embodiment, the washtub 200 and the moving body 214 are capable of optionally moving without revolving on their common axis. Thus, the moving tracks or orbits thereof can be easily changed according to agitating conditions. So the agitator can be employed to any mechanisms other than electric washers, and it is capable of raising the agitating efficiency.

In the present invention, the driving mechanism is not limited to the mechanisms shown in above described embodiments, a mechanism, for example, having: an X-guide; an X-traveller, which is capable of moving alongside the X-guide; a Y-guide fixed on the X-traveller and extended in the Y-direction; and a moving body, which is capable of moving alongside the Y-direction, can be employed as the driving mechanism for moving the agitating section.

Air cylinder units, oil motors, etc. may be employed instead of the motors in the driving mechanism.

The agitator of the present invention can be used to agitate, mix or dissolve fluids. And the agitator is capable of agitating powders. Further, the agitator can be employed to milling machines.

The agitating piece is not limited to a projection shown in the embodiments, its shape and size may be designed according to purposes.

The preferred embodiments of the present invention has been described, but the present invention is not limited to the above described embodiments, many modifications can be made without deviating from the scope and the spirit of the invention.

What is claimed is:

1. An agitator for agitating a medium, said agitator comprising:

an agitating section having a plurality of separated, agitating pieces attached thereto, each agitating piece extending away from the agitating section in a common extension direction; and a driving mechanism for creating a movement of the agitating section, the movement of the agitating section being in directions lying within a first plane, and the movement of the agitating section resulting in each agitating piece of said plurality of agitating pieces moving in a substantially identically shaped path.

2. The agitator according to claim 1, further comprising a reservoir section in which the medium to be agitated is stored, wherein said agitating section is provided in an inner bottom part of said reservoir section.

3. The agitator according to claim 1, further comprising a reservoir section in which the medium to be agitated is stored, wherein said agitating section is provided in an upper part of said reservoir section, and said plurality of separated, agitating pieces are extended downward from said upper part of said reservoir section.

4. The agitator according to claim 1, further comprising a reservoir section in which the medium to be agitated is stored, wherein said agitator has two agitating sections: one of said agitating sections is provided in an inner bottom part of said reservoir section; and another of said agitating sections is provided in an upper part of said reservoir section.

5. The agitator according to claim 1, further comprising a grip section in which said driving mechanism is accommodated, wherein said agitating section is detachably attached to said grip section.

6. The agitator according to claim 1, wherein said driving mechanism includes:

a first rotary shaft and a second rotary shaft being capable of respectively rotating on their axes, said first rotary shaft and said second rotary shaft being arranged in a first direction with a space;

a third rotary shaft and a fourth rotary shaft being capable of respectively rotating on their axes, said third rotary shaft and said fourth rotary shaft being arranged in a second direction perpendicular to the first direction with a space;

a first lever having one part fixed to said first rotary shaft, whereby said first lever is rotated together with said first rotary shaft;

a second lever having one part fixed to said second rotary shaft, whereby said second lever is rotated together with said second rotary shaft;

third lever having one part fixed to said third rotary shaft, whereby said third lever is rotated together with said third rotary shaft;

a fourth lever having one part fixed to said fourth rotary shaft, whereby said fourth lever is rotated together with said fourth rotary shaft;

a first moving guide having one end pivotably connected with another part of said first lever, and having another end pivotably connected with another part of said second lever;

a second moving guide having one end pivotably connected with another part of said third lever, and having another end pivotably connected with another part of said fourth lever;

a moving body being capable of moving on said first moving guide and a second moving guide;

first rotating means for rotating said first rotary shaft and said second rotary shaft; and second rotating means for rotating said third rotary shaft and said fourth rotary shaft.

7. The agitator according to claim 6, wherein said first rotating means rotates one of said first rotary shaft and said second rotary shaft, and said second rotating means rotates one of said third rotary shaft and said fourth rotary shaft.

8. The agitator according to claim 1, wherein said driving mechanism includes:

a first guide being arranged in a first direction;

a second guide being arranged in a second direction perpendicular to the first direction;

a moving body to which said agitating section is fixed, said moving body being capable of moving in the first direction along said first guide and in the second direction along said second guide in the first plane; and means for moving said moving body.

9. The agitator according to claim 1, wherein said driving mechanism includes:

a pair of first guides being arranged parallel in a first direction;

a pair of second guides being arranged parallel in a second direction perpendicular to the first direction;

a first moving guide being arranged parallel to said first guides, each end of said first moving guide being movably connected with each of said second guides whereby said first moving guide is capable of moving in the second direction along said second guides;

a second moving guide being arranged parallel to said second guides, each end of said second moving guide being movably connected with each of said first guides whereby said second moving guide is capable of moving in the first direction along said first guides;

a moving body to which said agitating section is fixed, said moving body being capable of moving in the first direction and the second direction, in a rectangular plane enclosed by said first guides and said second guides, on said first moving guide and said second moving guide;

first means for moving said first moving guide; and second means for moving said second moving guide.

10. The agitator according to claim 1, wherein the common extension direction is perpendicular to the first plane.

11. The agitator according to claim 10, wherein said driving mechanism comprises:

a plurality of lever assemblies, each lever assembly comprising a first lever having an input shaft and an output shaft connected thereto, the input shaft and the output shaft extending in parallel directions and being connected to the first lever a prescribed distance apart, the output shaft being pivotally connected to said agitating section;

a base section for holding the input shafts, while allowing rotation of the input shafts; and a drive system synchronously rotating the input shafts.

12. The agitator according to claim 11, wherein the parallel directions of said input and output shafts are also parallel to the extension direction of said plurality of separated, agitating pieces.

13. An agitator for agitating a medium in a container, said agitator comprising:

an agitating section having a plurality of separated, agitating pieces attached thereto, each agitating piece extending away from the agitating section substantially towards a mid-portion of the container; and a driving mechanism for creating a movement of the agitating section, the movement of the agitating section being in directions lying within a first plane, and the movement of the agitating section resulting in each agitating piece of said plurality of agitating pieces moving in a substantially identically shaped path.

14. The agitator according to claim 13, wherein said driving mechanism comprises:

a plurality of lever assemblies, each lever assembly comprising a first lever having an input shaft and an output shaft connected thereto, the input shaft and the output shaft extending in parallel directions and being connected to the first lever a prescribed distance apart, the output shaft being pivotally connected to said agitating section;

a base section for holding the input shafts, while allowing rotation of the input shafts; and a drive system synchronously rotating the input shafts.

15. The agitator according to claim 14, wherein the parallel directions of said input and output shafts are also parallel to the extension direction of said plurality of separated, agitating pieces.

* * * * *